US007694631B2

(12) United States Patent
Claas et al.

(10) Patent No.: US 7,694,631 B2
(45) Date of Patent: Apr. 13, 2010

(54) RAILWAY ANCHOR APPLICATOR MAGAZINE

(75) Inventors: Robert C. Claas, Saukville, WI (US); John K. Luvaas, Mequon, WI (US); Donald M. Treziak, Jr., Sturtevant, WI (US)

(73) Assignee: Nordco, Inc., Oak Creek, WI (US)

( * ) Notice: Subject to any disclaimer, the term of this patent is extended or adjusted under 35 U.S.C. 154(b) by 567 days.

(21) Appl. No.: 11/207,864

(22) Filed: Aug. 18, 2005

(65) Prior Publication Data

US 2007/0039511 A1 Feb. 22, 2007

(51) Int. Cl.
*E01B 29/24* (2006.01)

(52) U.S. Cl. ..... 104/17.2

(58) Field of Classification Search ..... 104/2, 104/4, 5, 16, 17.2
See application file for complete search history.

(56) References Cited

U.S. PATENT DOCUMENTS 5,142,987 A 9/1992 Freymuth et al.
5,398,616 A * 3/1995 Eidemanis et al. ..... 104/17.2
5,584,247 A * 12/1996 Almaraz et al. ..... 104/2

* cited by examiner

*Primary Examiner*—S. Joseph Morano
*Assistant Examiner*—Robert J McCarry, Jr.
(74) *Attorney, Agent, or Firm*—Greer, Burns & Crain, Ltd.

(57) ABSTRACT

A magazine for a railway anchor applicator having an anchor receiving mechanism for applying an anchor to a rail includes a chute structure. Configured for storing anchors in a sequential arrangement, the chute delivers the anchors to the anchor receiving mechanism.

12 Claims, 15 Drawing Sheets

FIG. 7A
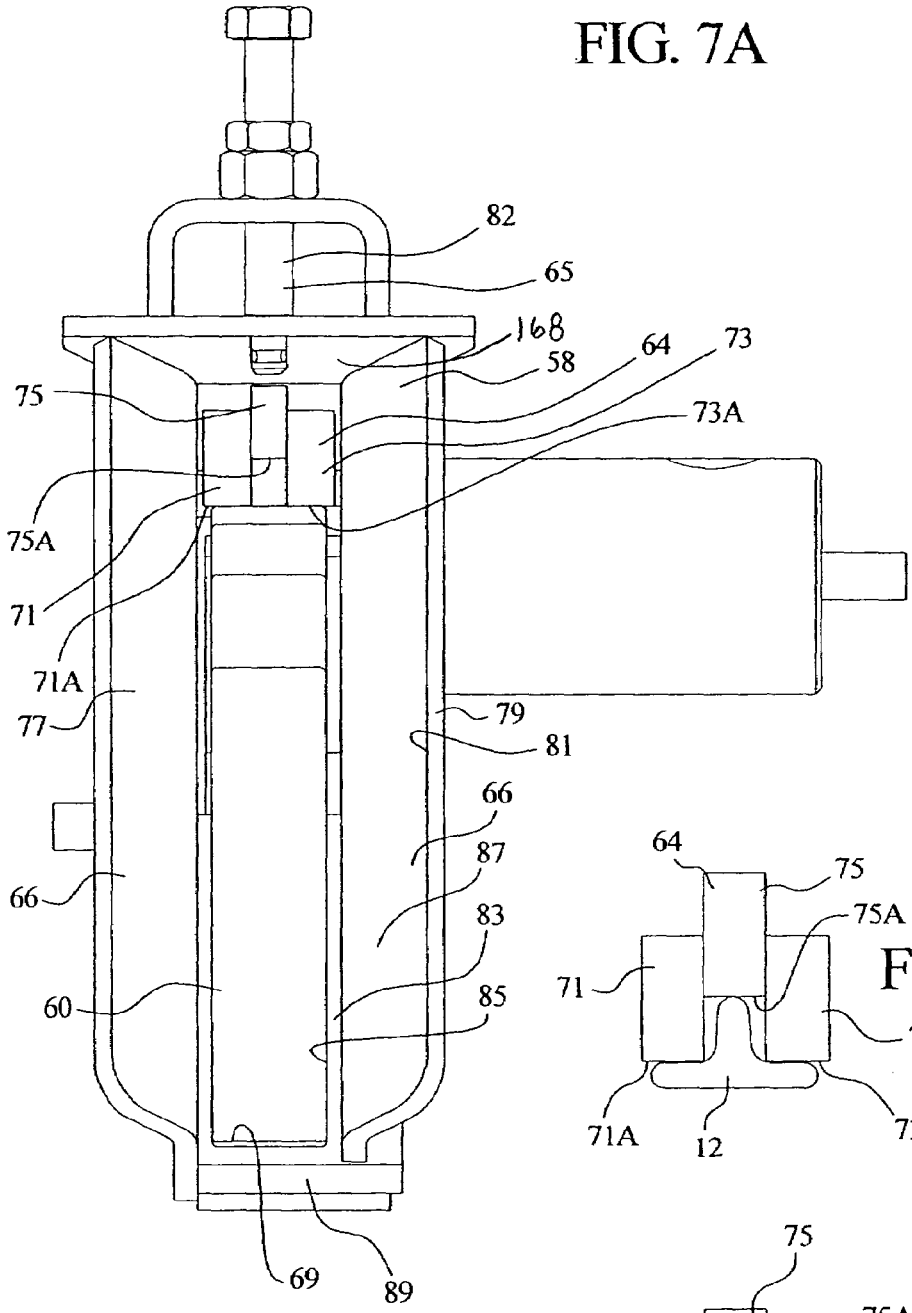
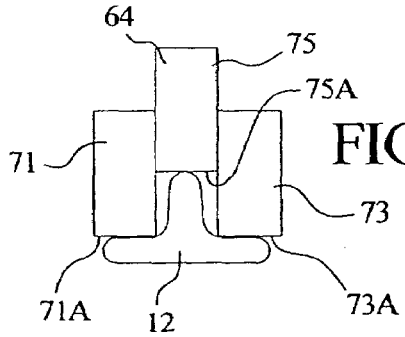
FIG. 7B
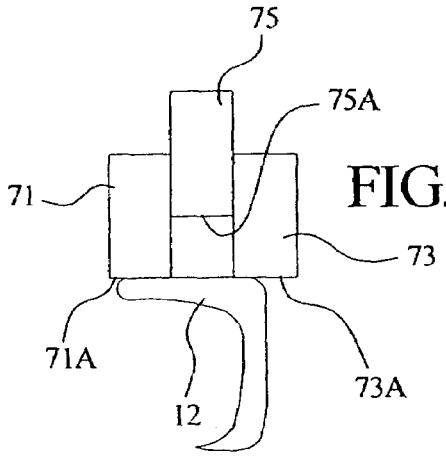
FIG. 7C

RAILWAY ANCHOR APPLICATOR MAGAZINE

CROSS-REFERENCE TO RELATED APPLICATION

This application is related to commonly assigned U.S. Pat. No. 7,647,871, entitled RAILWAY ANCHOR APPLICATOR.

BACKGROUND OF THE INVENTION

The present invention relates generally to railroad right-of-way maintenance machinery, and specifically to machinery used for applying anchors to rail ties for securing rail tie plates and rails to the ties.

A railway anchor clamps onto a rail, and is positioned to abut the tie and the tie plate, to resist the movement of the rail relative to the tie. Railway anchors as contemplated herein include different configurations and models of anchors, such as spring-type or drive-on anchors made by different manufacturers, or any other rail fasteners positioned adjacent tie plates and used for retaining tie plates upon the ties, as are known to those skilled in the art.

During the course of railroad maintenance work, it is common that existing rail anchors are removed during the replacement of rail ties, tie plates, rails and for other maintenance operations. Once the desired maintenance is complete, the anchors need to be reinstalled. Alternatively, the anchors themselves can fail and new anchors need to be installed in their place.

Railroad maintenance machines typically include a frame which is either self-propelled or towable along the track, and a workhead configured to perform the maintenance task. Such devices typically have a travel position, where the portion of the workhead is held sufficiently above the track to avoid damage by obstacles including the track itself, and a work position. During operation in the work position, the units typically move between a loading position for loading the repair part, and a track engaging position for applying the repair part. To avoid damage to the mechanisms, such units are designed for operation so that either travel is prohibited when these mechanisms are in the latter two positions, or the mechanisms automatically rise to the travel position when the unit begins to move to the next location.

While protecting the rail anchor applicator mechanisms, these conventional operational precautions tend to take time and limit productivity of the anchor application process. Further, in cases where the anchor applicator is one of a chain of maintenance machines, the productivity of the overall maintenance of the railroad is limited as measured by the rate of the slowest unit.

Further, in some prior art apparatuses for securing anchors onto rails, manual positioning of the anchors adjacent the rail is required before engagement onto the rail by the apparatus. This requires an additional person to place the anchor adjacent the rail, or requires the operator to perform two tasks: placement and application. In other prior art apparatuses, such as the apparatus disclosed by Freymuth et al., U.S. Pat. No. 5,142,987, anchors are continuously transported by a delivery mechanism. These known delivery mechanisms are unnecessarily complex and include multiple moving parts such as drive chains, pulleys, hydraulic motors, among other components.

Thus, there is a need for an improved rail anchor applicator which enables a high frequency of anchor applications while protecting the anchor applicating mechanisms.

There is also a need for an improved rail anchor applicator which is configured to continuously deliver anchors with minimal moving parts.

BRIEF SUMMARY OF THE INVENTION

The above-listed needs are met or exceeded by the present railway anchor applicator magazine provided for use with a railway anchor applicator with an anchor receiving mechanism for receiving at least one anchor, and an anchor positioning mechanism for positioning the anchor adjacent the rail. The magazine includes a chute configured for accommodating anchors in a sequential arrangement and delivering anchors to the anchor receiving mechanism.

Also provided is a loading portion for receiving an anchor in an anchor applicator magazine. The loading portion has a first end having an expanded width and a second end opposite the first end having a decreased width. Between the first end and the second end is at least one taper portion having a tapering width between the expanded width and the decreased width. The taper portion is configured to receive the anchor generally at the first end and to position the anchor at the second end to be located generally in the plane of a chute of the anchor applicator magazine. Additionally, the loading portion has a bottom portion disposed adjacent the taper portion and configured to feed, preferably under gravity, the anchor in either a head-to-tail or a tail-to-head orientation at the second end. The second end is configured to be integral with or disposed adjacent to the chute for depositing anchors into the chute.

A top guide for an anchor applicator magazine is also provided. The top guide includes first and second elongate members disposed substantially along the length of a chute of the magazine. The first member has a front surface that is generally coplanar with a front surface of the second member. A third elongate member is disposed substantially along the length of the chute. The third member is disposed between the first and second members and has a front surface offset from the front surfaces of the first and second members. In the top guide, at least one of the front surfaces is configured to slidingly receive an anchor along the length of the chute and to position the anchor into sliding engagement with a wall of the chute opposite the elongate members.

Also provided is a top guide for an anchor applicator magazine having an elongate member disposed substantially along the length of a chute of the magazine. The elongate member is configured to slidingly receive an anchor along the length and to position the anchor into sliding engagement with a bottom member of the chute located opposite the elongate member. Generally aligned with the chute, the elongate member is displaceable generally in the direction transverse to the length of the chute.

Further provided is an anchor magazine assembly having at least one generally elongate tray substantially defining a chute configured for sequentially delivering anchors from a first end of the tray to a second end of the tray. A top guide is disposed within the chute substantially along the length of the chute. The top guide is configured to slidingly receive an anchor along the length of the top guide and to position the anchor into sliding engagement with the tray.

Another anchor magazine assembly is provided which has a first generally elongate tray and a second generally elongate tray opposed to the first tray. Connecting the first and second trays together to substantially define a chute is an assembly structure. A top guide is disposed within and substantially aligned with the chute, the assembly structure connecting the top guide to the first and second trays.

Also provided is a bottom guide for a chute of an anchor applicator magazine. The bottom guide includes an elongate member disposed substantially along the length of a chute of the magazine. Further, the elongate member is configured to slidingly receive an anchor along the length of the member and to position the anchor into sliding engagement the top portion of the chute or the top guide of the chute, which is opposite the elongate member in the chute.

BRIEF DESCRIPTION OF THE SEVERAL VIEWS OF THE DRAWINGS

FIG. 7A is a top view of the anchor magazine of FIG. 5;

FIG. 7B is a top view of a top guide with a first anchor;

FIG. 7C is a top view of the top guide with a second anchor;

DETAILED DESCRIPTION OF THE INVENTION

Figure 1:
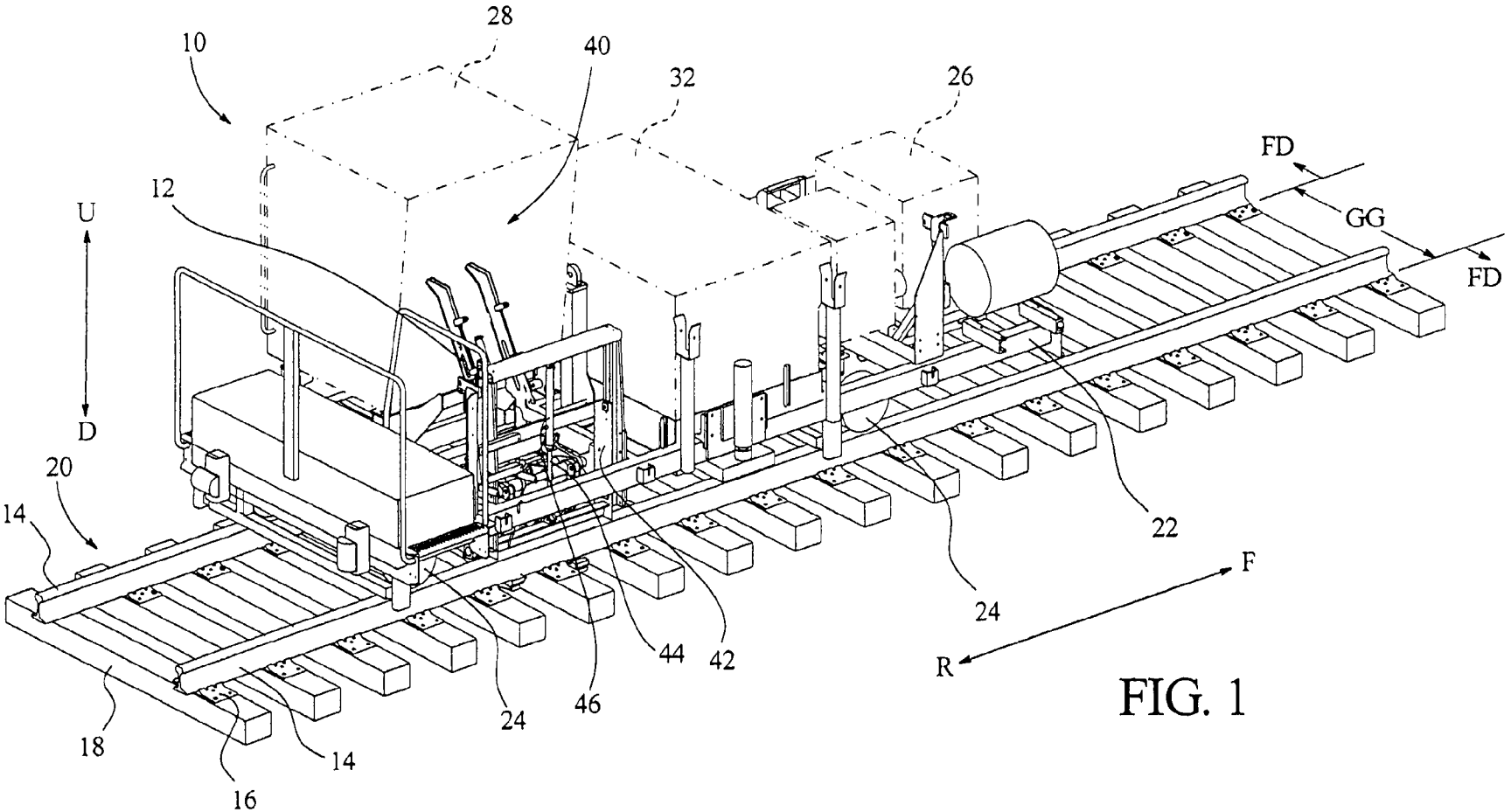
FIG. 1 is a perspective view of an anchor applicator machine incorporating the present invention.
Figure 2:
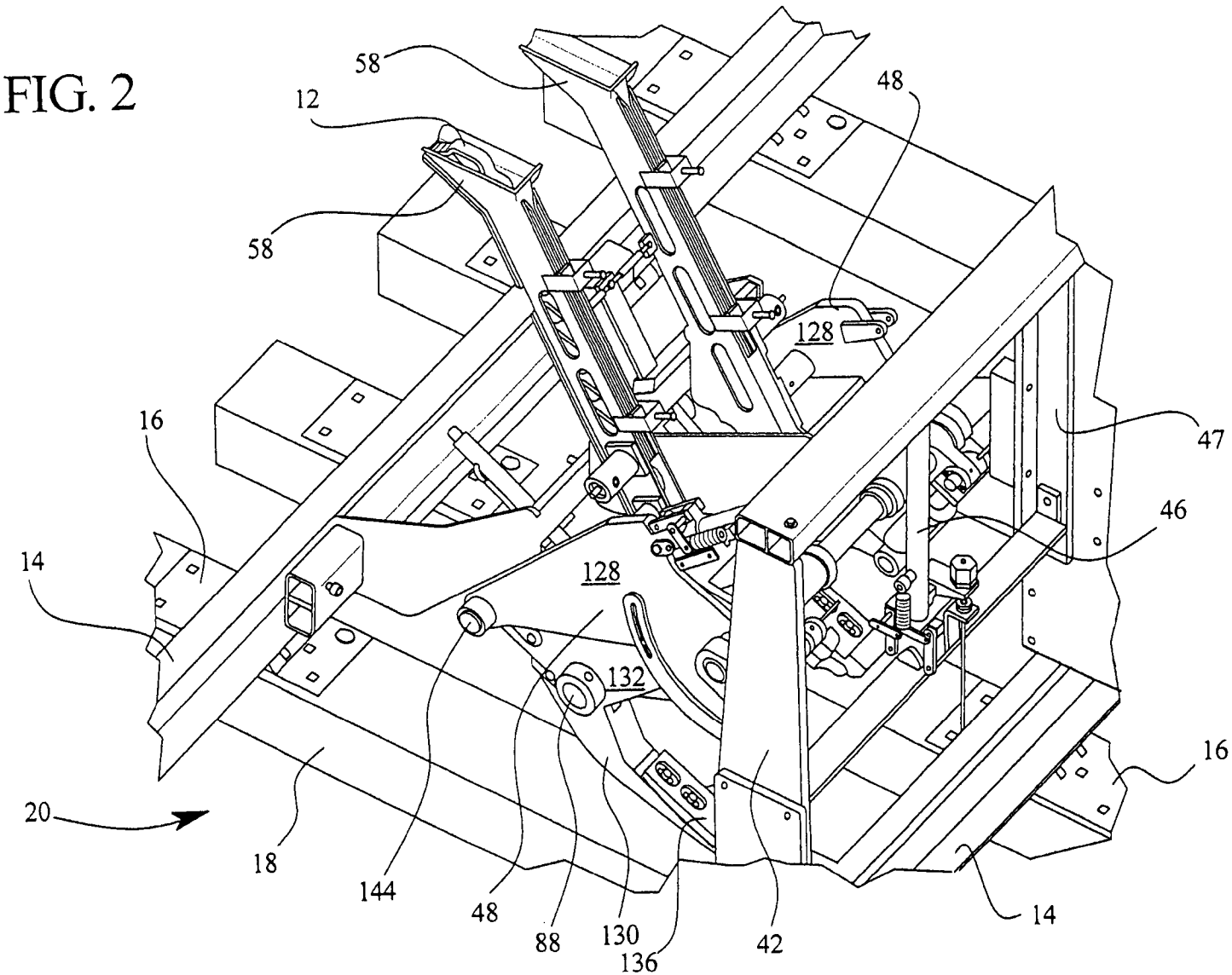
FIG. 2 is a partial perspective view of a workhead assembly of FIG. 1 positioned over the track with the remainder of the anchor applicator machine omitted.

Referring now to FIGS. 1 and 2, a railway anchor applicator incorporating the present invention is generally designated 10 and is designed for applying railway anchors 12 onto railroad rails 14 to secure rail tie plates 16 and ties 18 to the rails. The anchors 12, the rails 14, the tie plates 16 and the ties 18 are often collectively referred to as the railroad track, generally designated 20.

Figure 3:
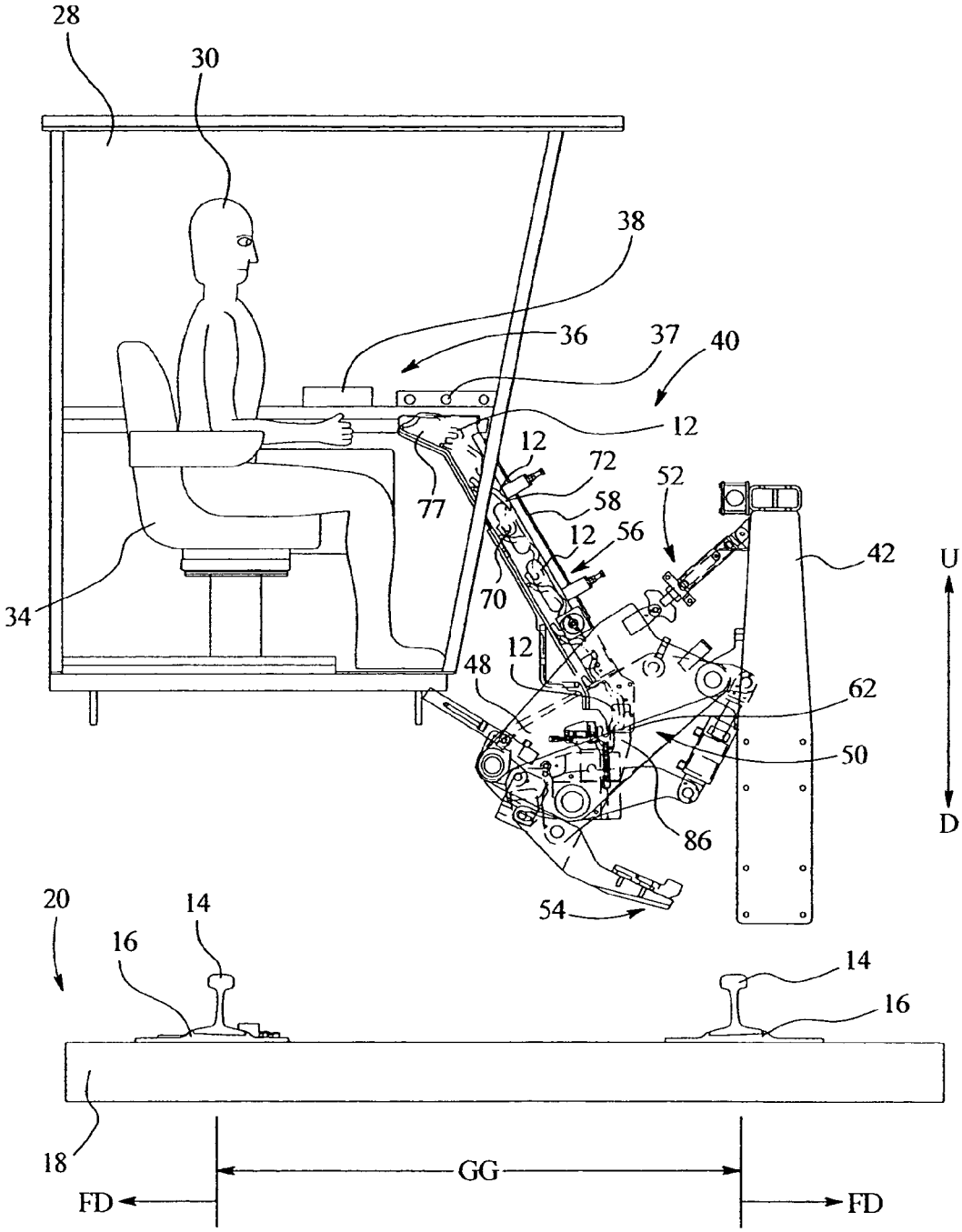
FIG. 3 is a side elevation of the workhead assembly loading an anchor.

Included on the applicator 10 is a frame 22 supported on wheels 24 such that the frame is movable along the track 20, either by being self-propelled by a source of motive power such as an engine 26 (shown schematically), or by being towable by another powered vehicle, as is well known in the art. At or near the rear of the applicator 10, an operator's station 28 is preferably included for housing an operator 30 (FIG. 3). A bulk storage compartment 32 (shown schematically) is preferably located in front of the operator's station 28 (in the direction of travel of the anchor applicator 10 along the track 20). Other components of railway maintenance machines can also be incorporated, as are known in the art.

For purposes of discussion, the forward direction "F" is towards the direction of travel, and the rearward direction "R" is away from the direction of travel. Also, the gage side "GG" of the track 12 is between the rails 14, while the field side "FD" is outside of each rail 14. Upwards "U" is away from the ground and downwards "D" is towards the ground. The length of the vehicle is measured along the track 12, and the width of the vehicle is measured across the track.

Referring now to FIG. 3, at least one operator's seat 34 is disposed in the operator's station 28 in operational relationship to a work area generally designated 36 having at least one operator input 37 such as a trigger, a switch, a joystick, a button or any other input mechanism. Extending from the bulk storage compartment 32 (FIG. 1) into the operator's station 28 is a bulk-loading conveyer 38 for receiving anchors 12 in the station. The anchors 12 (shown in phantom) travel from the bulk storage compartment 32, up the conveyer 38, and into the operator's station 28 where the operator can remove the anchors from the conveyer.

Referring back to FIGS. 1 and 2, a work area generally designated 40 is preferably defined between a work frame 42 and the operator's station 28 as a recess corresponding to one of the two rails 14 of the track 20. As is known in the art, the work frame 42 includes at least one piston rod or shaft 44 extending from a fluid power cylinder 46 used to selectively position a moving frame 47 vertically to the rails 14 over portions of the track 20 needing maintenance. The moving frame 47 is moved under hydraulic power from the fluid power cylinder 46 within the work frame 42. Other arrangements are contemplated for controlling movement vertical to the rail 14. Further, arrangements configured for movement parallel to the rail (forward) "F" and rearward "R" and movement transverse to the rail (gage "66" to field "FD") are contemplated.

In the anchor applicator 10, preferably the work area 40 is provided with at least one and preferably two workhead assemblies 48. Only one such assembly will be described in detail, since the units are preferably identical or substantially identical to each other. The workhead assembly 48 is movably mounted on the work frame 42 for vertical movement toward and away from a tie 18 (upward "U" and downward "D") to adjust the movement of the workhead 48 to a particular height of the rail 14.

As seen in FIG. 3, the workhead assembly 48 preferably includes three mechanisms, an anchor receiving mechanism 50, an anchor positioning mechanism 52 and an anchor clipping mechanism 54. While these mechanisms will be described in detail with respect to FIGS. 4A-4K, a brief overview of the mechanisms will be provided. First, the anchor receiving mechanism 50 is configured for movement between a first position receiving at least one anchor 12 from an anchor input 56 and a second position placing the anchor at a location away from the anchor input. Preferably, the anchor receiving mechanism 50 pivots the anchor 12 downward "D" towards the rail 14.

The second mechanism is the anchor positioning mechanism 52 which is configured for movement of the workhead assembly 48 between a retracted and an extended position for positioning the anchor 12 adjacent to the rail 14. The movement of the anchor positioning mechanism 52 is preferably vertical movement downward "D", as well as rotation about the work frame 42.

Third, the anchor clipping mechanism 54 positively engages the anchor 12 against the rail 14 by imparting pressure on the anchor transversely across the rail. In the preferred embodiment, the anchor 12 is positioned from the gage side "GG" as the mechanism 54 moves underneath the rail 14 towards the field side "FD" of the rail. Then, the anchor 12 is clipped onto the rail 14 by moving the anchor upwards and back towards the gage side "GG" to compress it against the flange of the rail. The three mechanisms will be described in greater detail with respect to FIGS. 4A-4K after additional structure is introduced.

Before the workhead assembly 48 can apply an anchor 12 to the rail 14, the anchor must be input into the workhead assembly 48 from the anchor input 56. While the anchor input 56 is contemplated as any manner of feeding anchors to the workhead assembly 48, including manual feeding directly to the anchor receiving mechanism, an anchor magazine 58 is preferably provided for each workhead assembly.

Referring now to FIGS. 3, 6 and 7A-7C, the anchor magazine 58 is configured for storing a plurality of rail anchors 12 and delivering them sequentially, preferably under gravity feed, for engagement with the anchor receiving mechanism 50. The magazine 58 is preferably a chute structure 60, preferably having an inclined orientation, which preferably extends generally from the operator's work area 36 to a drop off point 62 adjacent the anchor receiving mechanism 50. While the chute structure 60 preferably is inclined, it is contemplated that any orientation may be used.

The magazine 58 guides the anchors 12 disposed within the chute 60 toward a delivery point 68 in a sequential alignment. While other orientations and configurations are contemplated, the present anchor magazine 58 is configured for accommodating the anchors 12 in an arrangement such that a head 70 of the anchor is oriented in the direction of the rails 14 and a belly 72 is facing upwards "U" (best seen in FIG. 3*a*). Further, the anchors 12 have tails 74, and are preferably disposed in a head-to-tail arrangement, although a tail-to-head arrangement is also contemplated.

Figure 6:
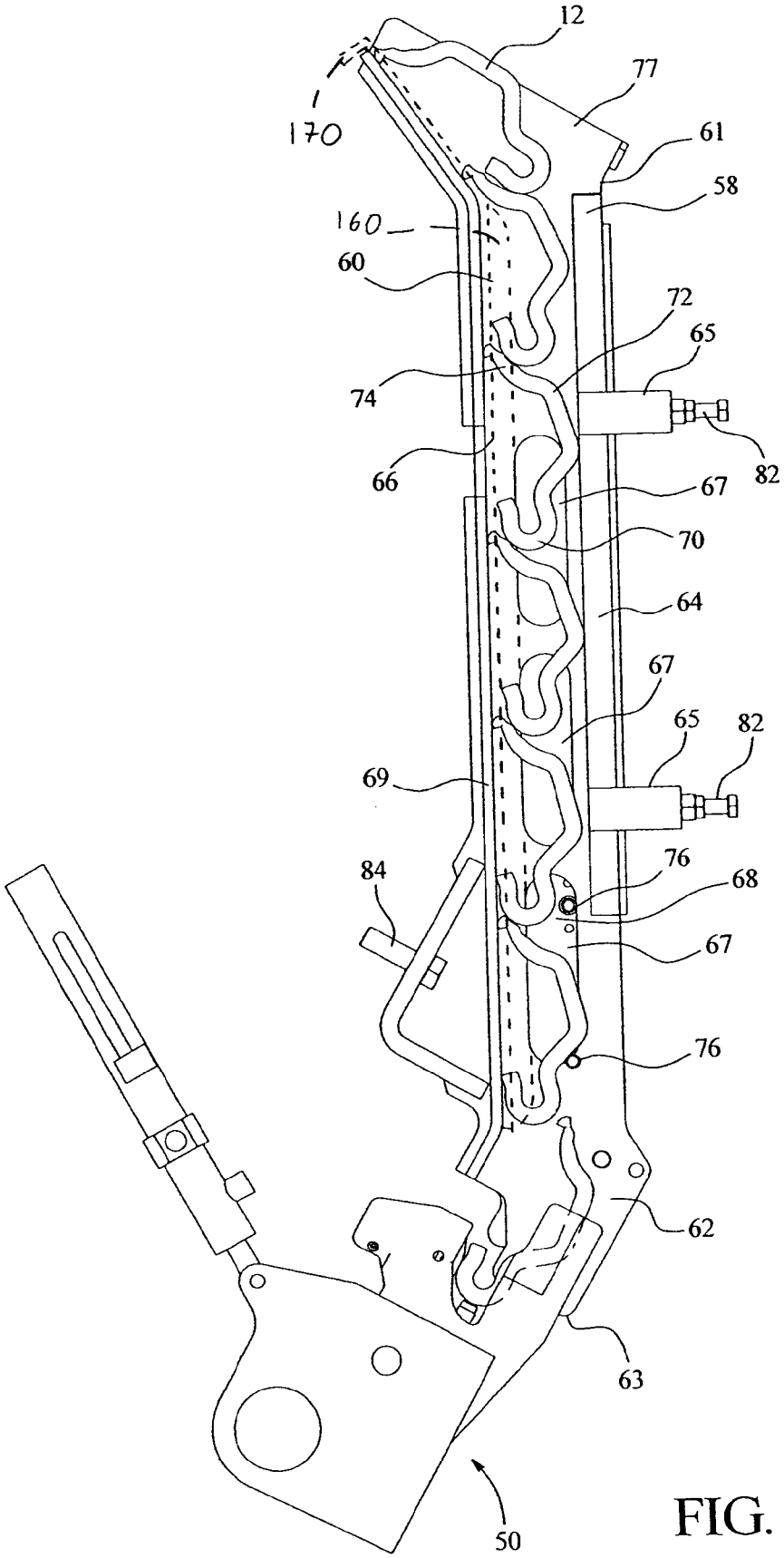
FIG. 6 is a side elevation of an anchor magazine of the workhead assembly of FIG. 1 with a portion of the magazine removed to view anchors.
Figure 7D:
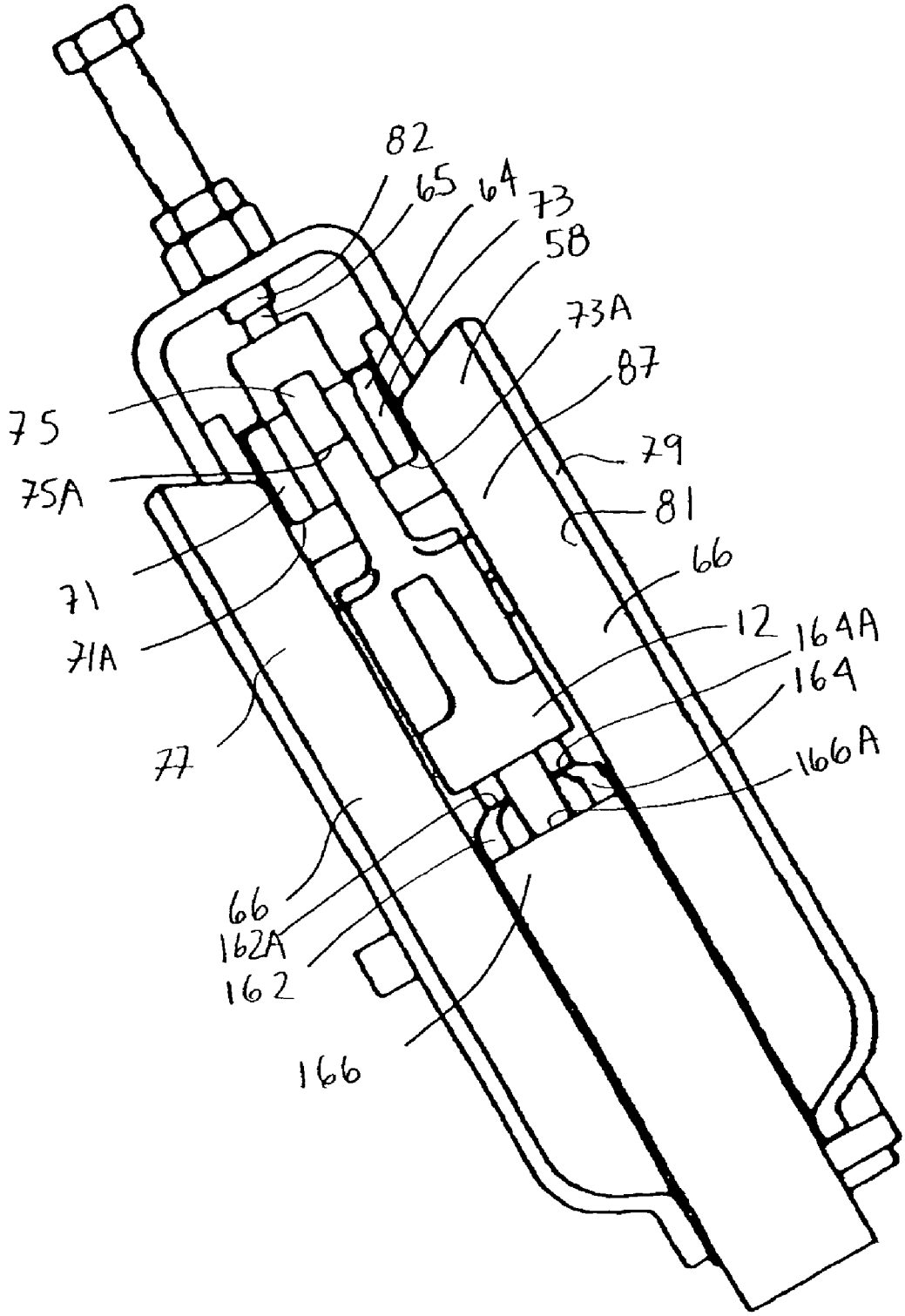
FIG. 7D is a top view of the anchor magazine of FIG. 5 with a bottom guide disposed along the magazine.

The magazine 58 is preferably made of a top guide 64 and at least one tray 66 forming the confines of the chute 60. In the preferred embodiment, two generally "L"-shaped trays 66 oppose each other and substantially define a generally "U"-shaped chute 60 to sequentially feed anchors from a top end 61 of the tray to a bottom end 63 of the tray. FIG. 6 depicts the magazine 58 with one of the trays 66 removed to show the alignment of the anchors 12. A bracket-like assembly structure 65 preferably connects the trays 66 together. Further, windows 67 are preferably disposed in each tray 66 to reduce material and weight of the tray, and also to enable the operator 30 to view the anchors 12 within the magazine 58.

The top guide 64 is an elongate member disposed within the chute 60 and configured to slidingly receive the anchors 12 substantially along the length of the chute. The top guide 64 preferably also positions each anchor 12 into sliding engagement with a bottom portion 69 of the chute opposite of the top guide.

To facilitate different sizes and shapes of anchor 12, the top guide 64 is preferably adjustable within the trays 66. While the top guide 64 is generally aligned with the chute 60, the top guide is displaceable generally in the direction transverse to the length of the chute. Preferably secured to at least one of the trays 66 by threaded fasteners 82 engaging the corresponding assembly structure 65, the top guide 64 can be adjusted to change the inner cross-sectional area of the chute 60 to accommodate and align various types, shapes and sizes of anchors 12.

Referring now to FIGS. 7A-7C, in the preferred embodiment of the top guide 64, there are a first and a second elongate member 71, 73 disposed substantially along the length of the chute 60. The first member 71 has a front surface 71*a* that is generally coplanar with a front surface 73*a* of the second member 73. A third elongate member 75 is disposed substantially along the length of the chute 60 between the first and second members 71, 73, preferably forming a channel. The third member 75 also has a front surface 75*a*, the front surface being offset from the first and second front surfaces 71*a*, 73*a*. At least one of the front surfaces 71*a*, 73*a*, 75*a* is configured to slidingly receive the anchor 12 along the length of the chute 60 and to position the anchor into sliding engagement with the bottom portion 69 of the chute.

In this configuration of first, second and third members 71, 73, 75, a variety of anchors 12 can be accommodated (FIGS. 7B and 7C). The first, second and third members 71, 73, 75 can be separate members adjustably moveable with respect to each other, or can be integral or attached to each other. Further, the first, second and third members 71, 73, 75 are displaceable generally in the direction transverse to the length of the chute 60 to effectively decrease the inside surface area of the chute. The top guide 64 is displaced by adjusting the fasteners 82 on the assembly structure 65. By decreasing the inside surface area of the chute 60, the top guide 64 can maintain the anchors into confinement between the members 71, 73, 75 and the bottom portion 69 of the chute to keep the anchors in an orderly, sequential alignment in the chute 60.

For ease of retrieving anchors 12 from the bulk-loading conveyor 38 and feeding the anchors to the magazine, a loading portion 77, preferably flared in shape, preferably extends into the operator's station 28, preferably at the operator's work area 40, and more preferably within the operator's reach. The loading portion 77 is also preferably integral with or disposed adjacent to the top end 61 of the trays 66 for facilitating the deposit of anchors 12 into the chute 60. The loading portion 77 is a funnel-like structure providing an enlarged area in which to load the anchors into the magazine 58.

Specifically, the loading portion 77 has a first end 79 preferably defining a generally rectangular orifice 81, and an expanded width. Opposite the first end 79, a second end 83 also preferably defines a generally rectangular orifice 85 and has a relatively decreased width. In the preferred embodiment, the width at the first end 79 is about three times the width at the second end 83.

Between the first end 79 and the second end 83, a taper portion 87 is disposed which has sloping sides and a tapering width between the first rectangular orifice 81 of expanded width and the second rectangular orifice 85 of decreased width. The taper portion 87 is configured to receive the anchor 12 at the orifice 81, and to position the anchor at the second end 83 to be aligned with the chute 60 of the magazine 58.

A bottom portion 89 is disposed adjacent the taper portion 87. The bottom portion 89 is configured to align and to feed the anchor 12, preferably under gravity down the chute 60 in a head-to-tail or tail-to-head orientation when the anchor exits the second end 83.

The bottom portion 69 is preferably elongate and disposed substantially along the length of the chute 60. Configured to slidingly receive the anchor 12, the bottom portion 69 is preferably a smooth, integral surface with the trays 66.

At the opposite end of the chute 60 from the loading portion 77 is the delivery point 68. Preferably at least one escapement pin 76 (FIG. 6), powered by a fluid power cylinder (not shown) which selectively permits the delivery of one anchor 12 at a time under operator control, is located at the delivery point 68. More preferably, two escapement pins 76 work in tandem to permit one anchor 12 to pass between the two pins, from the delivery point 68 to the drop-off point 62, and one anchor to be delivered from the drop-off point 62 to the anchor receiving mechanism 50. The operator 30 preferably operates the escapement pins 76 using the operator input 37.

The magazine 58 is preferably pivotable with respect to the frame 22, specifically about a magazine pivot point 84 to allow the operator 30 to accurately place a variety of anchors 12 into the anchor receiving mechanism 50. The pivoting of the magazine 58 is used to correct any off-center placement of certain types of anchors 12 into the anchor receiving mechanism 50.

Referring now to FIGS. 3, 4A-4C and 8, the anchor receiving mechanism 50 includes an anchor holder 86 (FIG. 8) configured for movement between a first, or loading position for sequentially receiving an anchor 12 from the anchor input 56, and a second position placing the anchor in an applying position away from the anchor input 56. The anchor receiving mechanism 50 is preferably configured for lowering and axially rotating each anchor 12 from the first position to the second position. Preferably, the vertical (lowering) movement component and the rotational movement of the anchor receiving mechanism 50 about main pivot 88 are performed in close temporal succession, and even more preferably, these movements occur simultaneously, as will be described below.

The anchor receiving mechanism 50 includes a first actuator 90, preferably a fluid power cylinder having a reciprocating piston (not shown). More specifically, the first actuator 90 pivotally moves an anchor receiving arm 92 about the main pivot 88. The pivoting of the anchor receiving arm 92 displaces the anchor 12 downward toward the rail 14 and outward toward the field side "FD" of the track 20. This preferred rotation not only moves the anchor 12 from the drop-off point 62 to a location where the anchor can be readily applied to the rail 14, but it places the tail end 74 of the anchor towards the rail. Thus, the anchor 12 is generally pivoted about the head 70 of the anchor and has a generally 180-degree orientation from the orientation in which it is placed in the loading portion 77 of the magazine 58.

Figure 8:
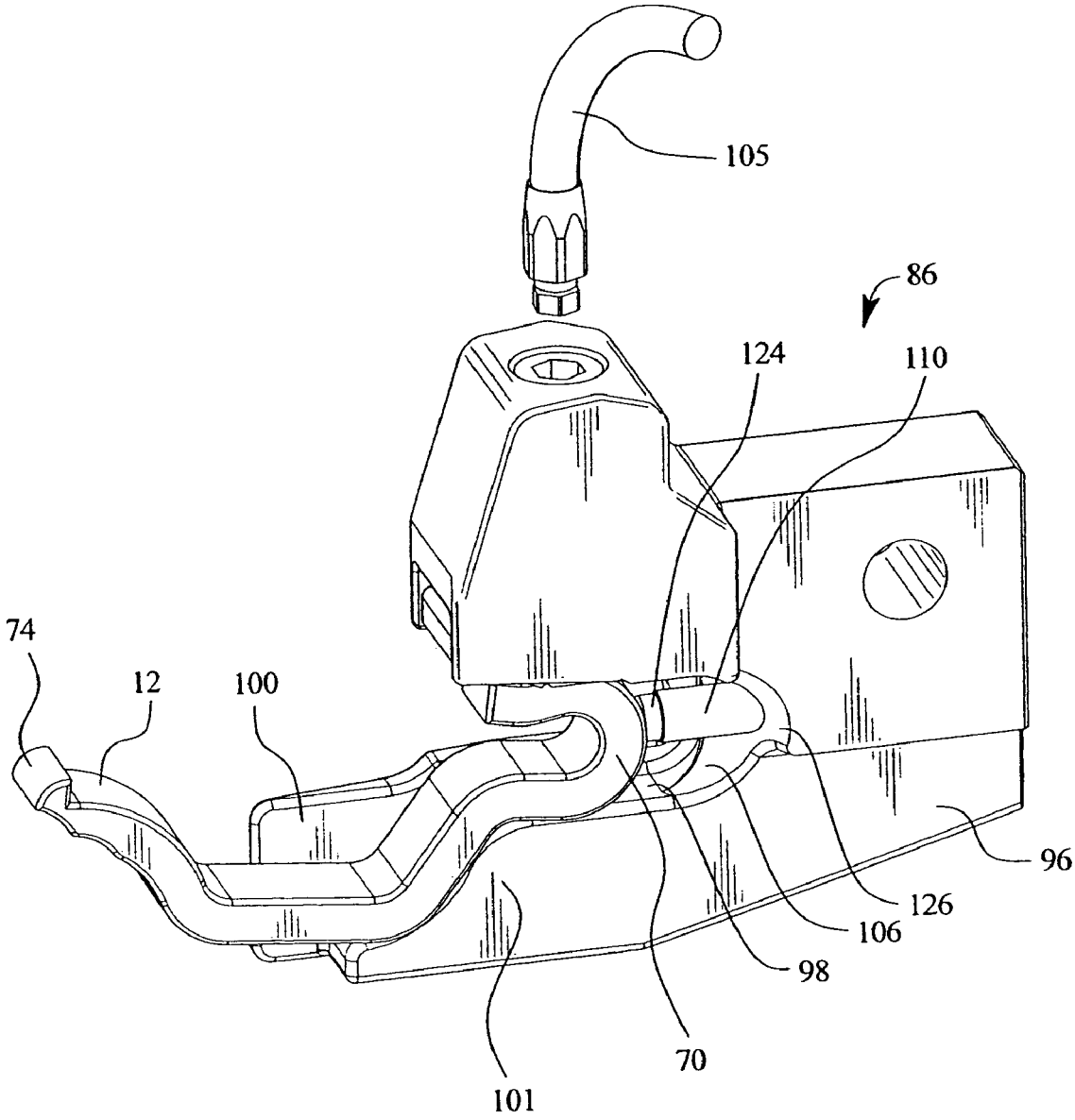
FIG. 8 is a perspective view of an anchor holder of the workhead assembly of FIG. 1.
Figure 9:
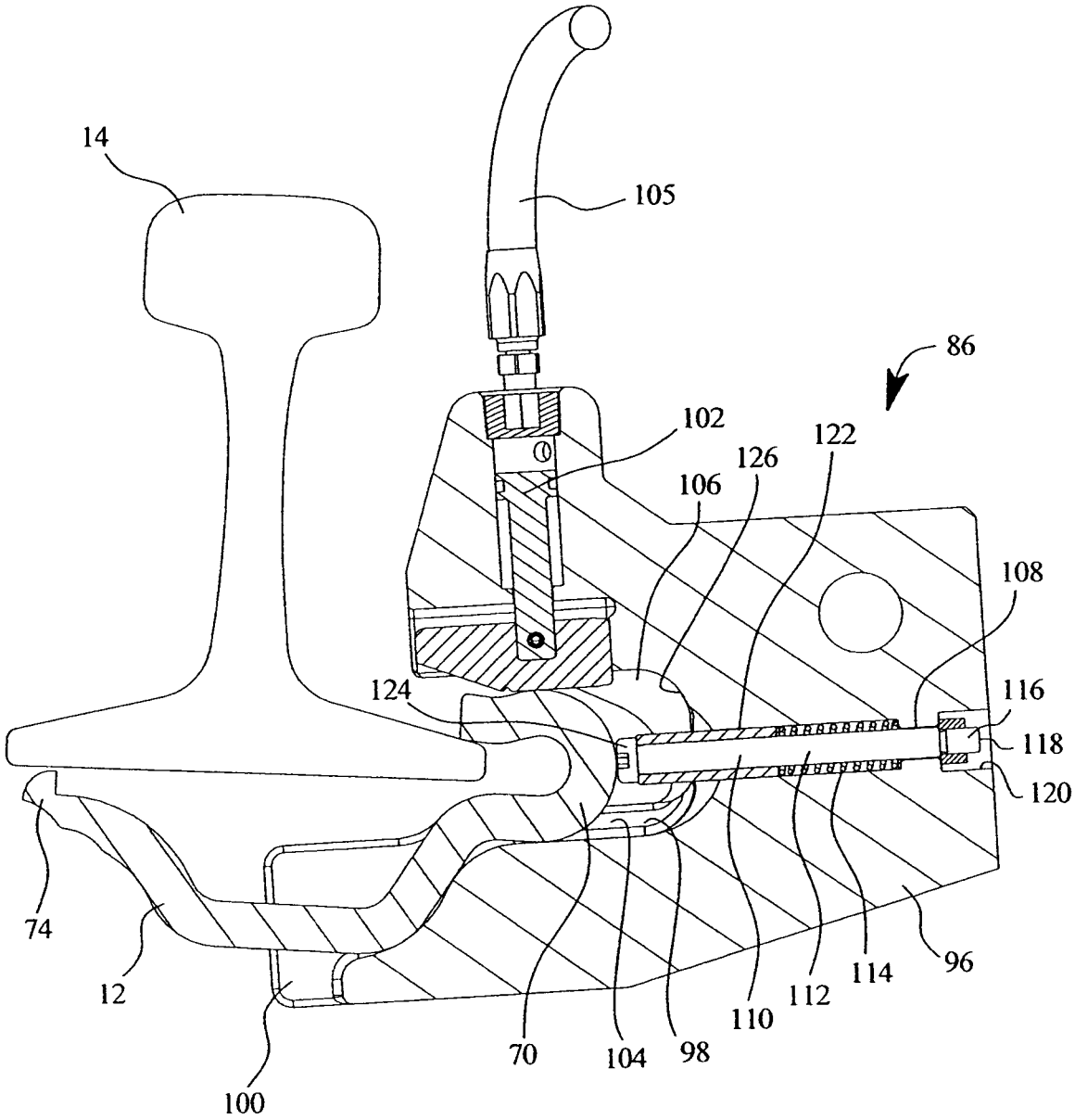
FIG. 9 is a vertical cross-section of the anchor holder of FIG. 8.

Referring now in detail to the anchor holder 86 in FIGS. 8 and 9, the anchor holder preferably includes a generally "U"-shaped support block 96, the inside of the "U"-shape preferably defining a seat 98 for receiving the anchor 12. The seat 98 is preferably sized and shaped to accommodate a variety of anchors 12, while maximizing the amount of contact between the anchor and the seat to retain the anchor in the anchor holder 86. When the anchor 12 is deposited into the anchor holder from the magazine 58, the anchor is preferably received head-first in the seat 98 such that the tail end 74 of the anchor extends from the support block 96 (FIG. 8).

When an anchor 12 is received from the magazine 58, the anchor holder 86 has a generally vertical orientation so that the anchor is generally placed or dropped into the seat 98 (FIG. 3). A retaining wall 100 is preferably disposed adjacent the seat 98 to provide an additional restraint to keep the anchor 12 in the seat. Opposite the seat 98 from the retaining wall 100 is an open side 101. Further, a clamp 102 is disposed preferably within the support block 96 generally transverse to the direction of the legs of the "U"-shape. The clamp 102 is preferably a movable member that engages the anchor 12 at the anchor head 70, and retains the anchor within the seat 98 by pushing the anchor against an opposing wall 104 of the seat. As is known in the art, the clamp 102 may be operated by a hydraulic activator 105 (schematically represented as a hose), or by any other means to effect a clamping force on the anchor 12.

The seat 98 in the support block 96 preferably includes a recess 106 that extends backward toward the base of the "U"-shape. The recess 106 is configured for accommodating different types of anchors 12 having different shapes and sizes to allow a variety of types of anchors to be operatively seated. The recess 106 is also configured to provide additional space for allowing the anchor 12 to bend, deform, or otherwise position itself upon the rail 14 in the clipping process (FIG. 9).

At the base of the "U"-shape, the support block 96 is provided with a mounting bore 108 for a plunger rod 110. The plunger rod 110 is disposed within the mounting bore 108 and includes a shaft 112 circumscribed by a compression spring 114. As is known in the art, suitable fasteners 116 are provided at a mounted end 118 of the plunger rod 110 where the rod is slidably received in the bore 108 and secured to the support block 96, preferably to retain the plunger rod 110 in position. Further, preferably the mounted end 118 is disposed in a counterbore 120 so as not to protrude to the outside surface of the anchor holder 86.

In the preferred embodiment, the compression spring 114 acts on a sleeve 122 circumferentially disposed on the shaft 112. The spring 114 biases the sleeve 122 away from the spring, and a plunger tip 124 disposed on the end of the sleeve is configured to bias the head 70 of the anchor 12 in an operational position away from a back recess wall 126.

When the anchor 12 is first positioned in the anchor holder 86, the plunger rod 110 dampens the impact of the anchor in the seat 98. Further, when the anchor 12 is positioned adjacent a rail 14, the plunger tip 124 biases the anchor towards the rail (FIG. 9). Additionally, when the anchor 12 bends, deforms or otherwise positions itself on the rail 14, the force of the anchor can overcome the bias of the spring 114, which allows the anchor to use the space within the recess 106 to maneuver and position itself on the rail.

To engage the anchor 12 on the rail 14, the anchor positioning mechanism 52 must first position the anchor adjacent the rail. The anchor positioning mechanism 52 will be described with respect to the preferred embodiment, however, it is contemplated that other mechanical structures can be used which move between a retracted and extended position, generally vertically and rotationally, for positioning the anchor 12 adjacent to the rail 14 at either the field side "FD" or the gage side "GG" of the rail.

The movement of the workhead assembly 48 will be described with reference to FIGS. 3 and 4A-4K, which are a series of "snapshots" of the movement of the workhead assembly. Generally, the workhead assembly 48 includes a plurality of links including the anchor receiving arm 92, a main pivot arm 128, a bar clamp arm 130, a large arm 132 and a minor arm 134 in operational relationship with each other.

The workhead assembly 48 also includes a plurality of actuators 136 including the first actuator 90 for pivoting the anchor receiving arm 92 with respect to the bar clamp arm 130 to position the anchor 12 adjacent the bar clamp arm, a second actuator 138 for pivoting the main pivot arm 128 with respect to the moving frame 47 to position the anchor adjacent the rail 14, and a third actuator 140 for pivoting the minor arm 134 with respect to the main arm 128 to clip the anchor to the rail. Since movement of any component of the workhead assembly 48 is effected by any actuator 136 and is dictated by the particular structure of the workhead assembly links, it is contemplated that a variety of linkages and actuators may be employed.

The main pivot arm 128 is generally triangular when viewed from the front of the machine and is pivotally attached both to the second actuator 138 and to a frame pivot point 142. Extension of the second actuator 138 effects the counterclockwise pivoting (as viewed in FIGS. 4C-4G) of the main pivot arm 128 about the frame pivot point 142. When the main pivot arm 128 is pivoted, the large arm 132 and the third actuator 140 are pivoted about the frame pivot point 142 with respect to the moving frame 47. Also, when the main pivot arm 128 is pivoted, the bar clamp arm 130, the anchor receiving arm 92 and the minor pivot arm 134 are also rotated and displaced relative to the moving frame 47.

Figure 4A:
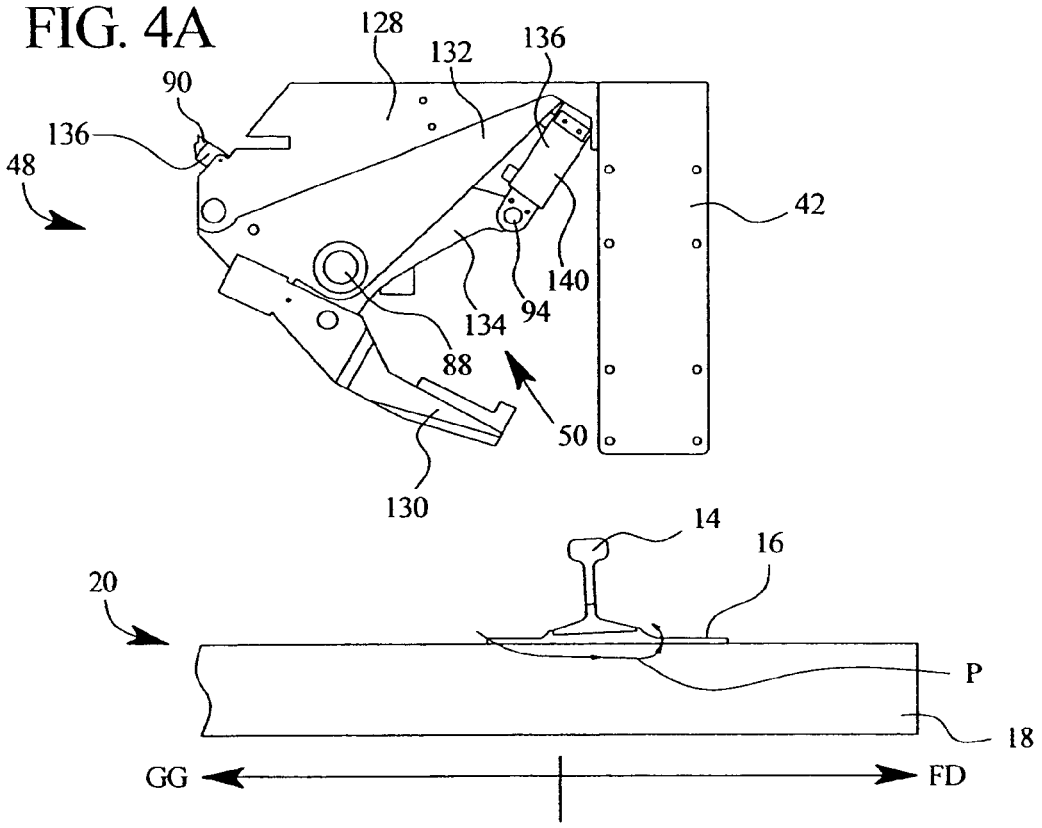
FIGS. 4A-K are a sequence of side elevations of the workhead assembly applying an anchor to the rail.
Figure 4B:
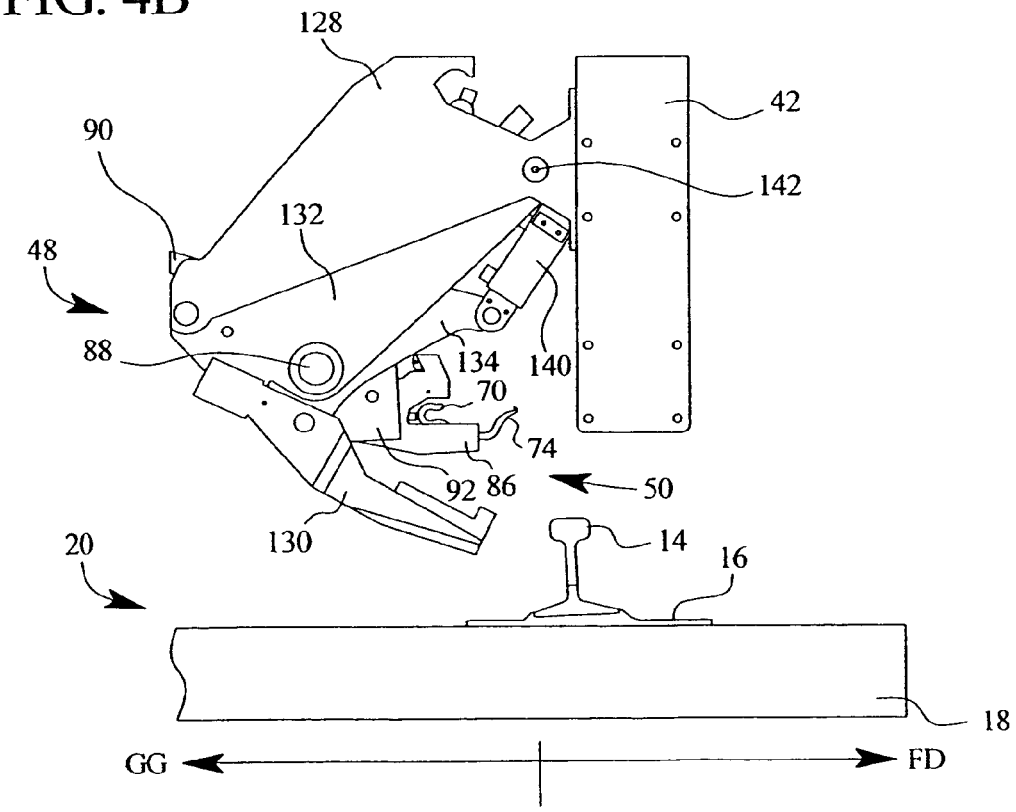
Figure 4C:
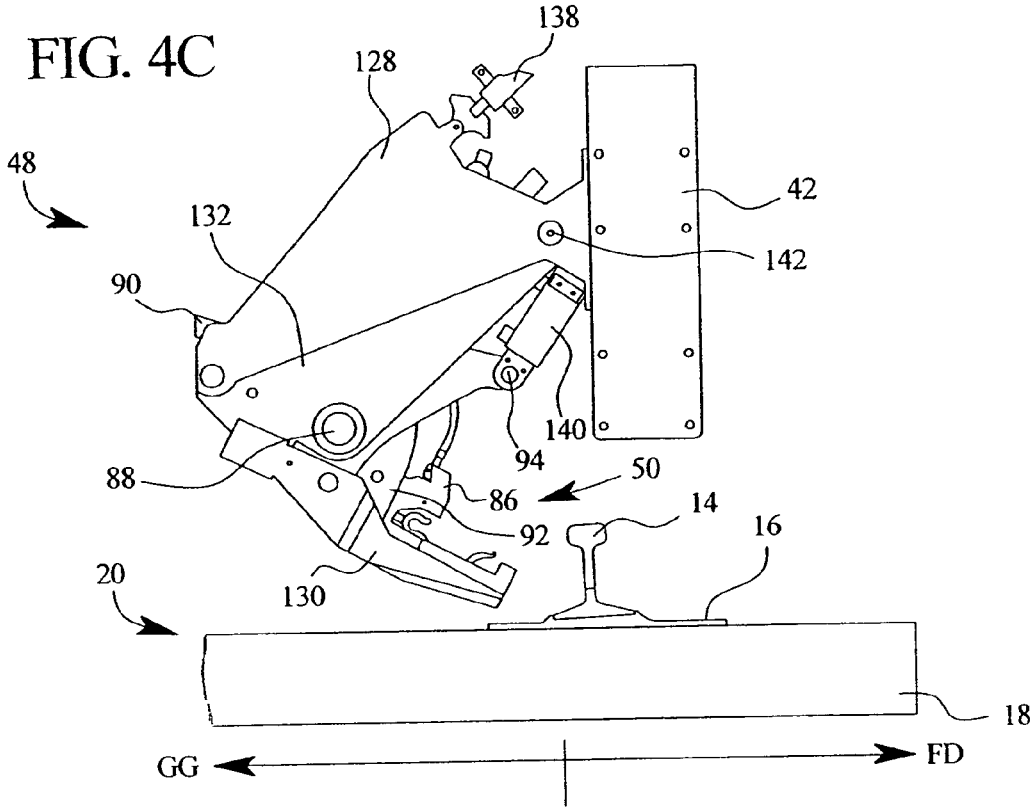
Figure 4D:
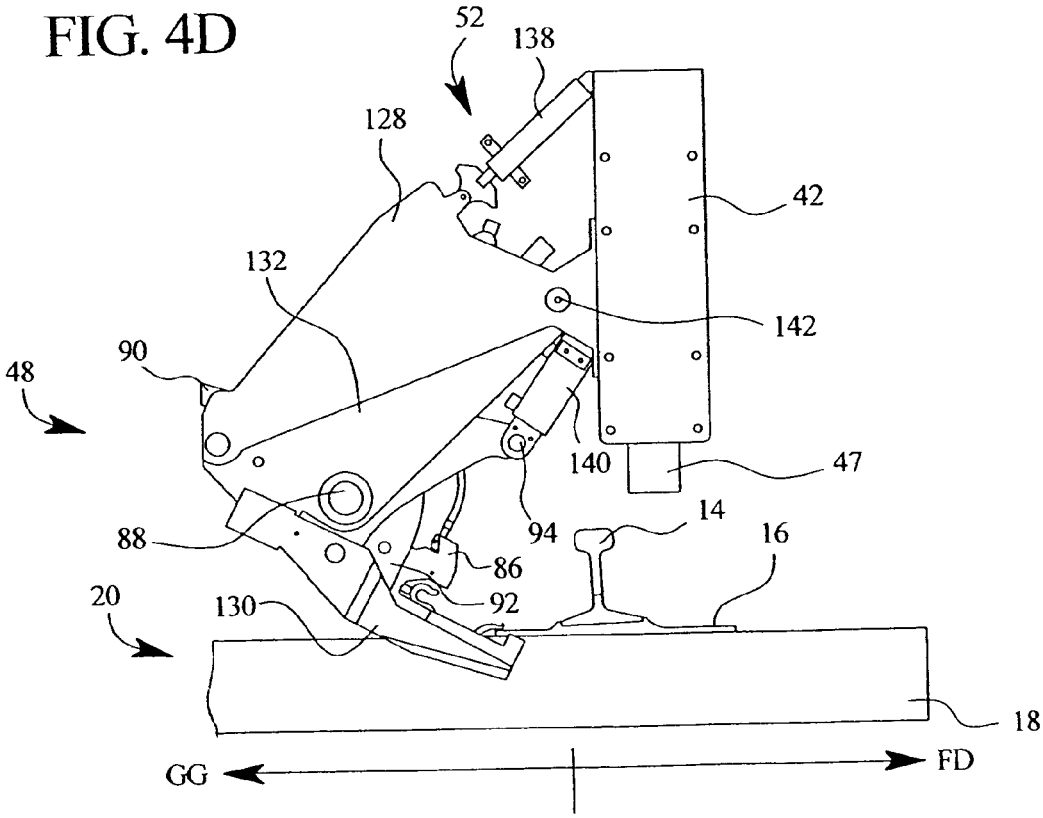
Figure 4E:
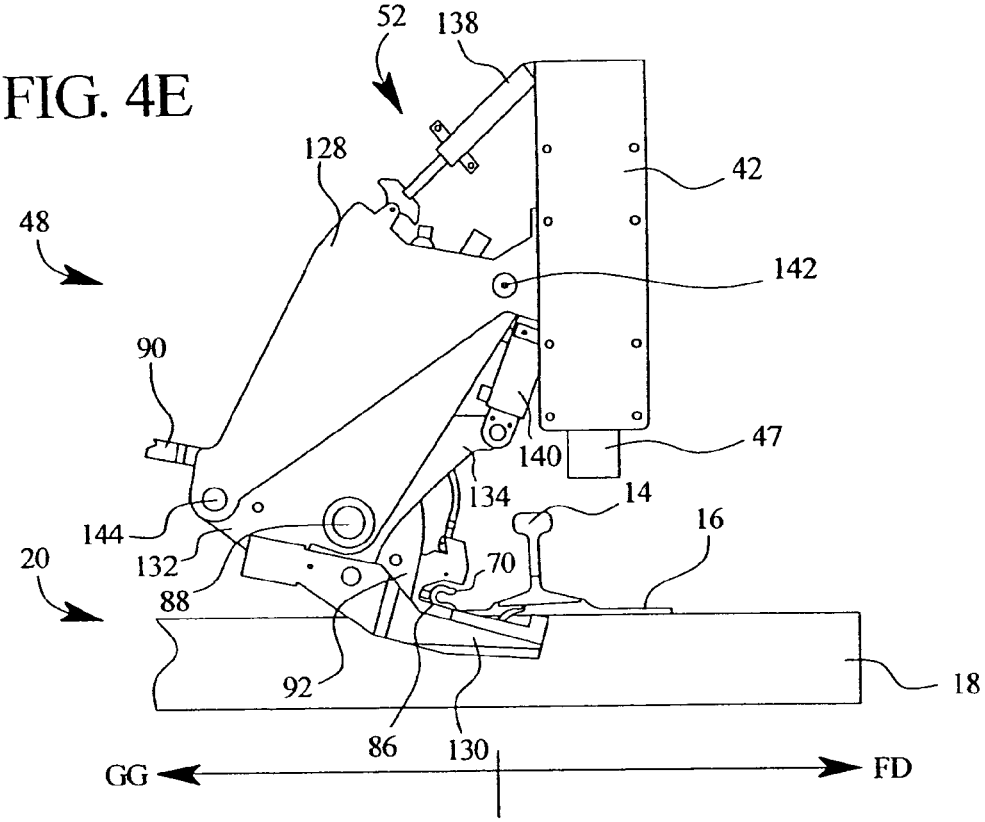

Since the anchor receiving arm 92 is displaced during actuation of the anchor receiving mechanism 50, the anchor receiving arm 92 is generally aligned with the bar clamp arm 130 (FIG. 4C). Thus, when the main pivot arm 128 is pivoted during actuation of the anchor positioning mechanism 52, the anchor receiving arm 92 and the bar clamp arm 130 are both rotated together to be generally parallel with the ties 18 (FIG.

4F). Both the anchor receiving arm 92 and the bar clamp arm 130 are also displaced towards the rail 14 (FIG. 4C-4F).

Simultaneously or in succession with the pivoting of the main pivot arm 128, the workhead assembly is 48 displaced downward towards the rail 14 by movement of the moving frame 47 relative to the work frame 42 (FIG. 4A-4D). As is known in the art, a separate fluid power cylinder is used to control this movement. In particular, through this motion a second actuation pivot point 144 and the frame pivot point 142, displace downward relative to the track 20. This moves the bar clamp arm 130 downward toward to the rail 14.

Figure 4F:
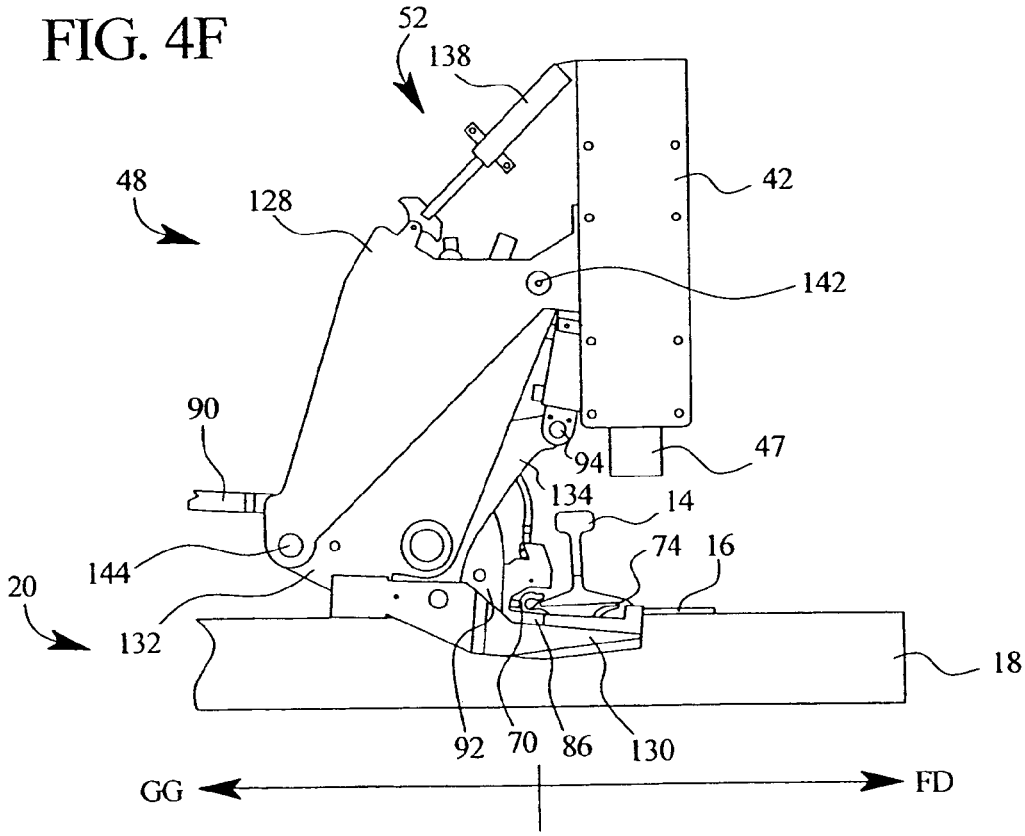

In FIG. 4F, the anchor positioning mechanism 52 positions the anchor 12 adjacent the rail 14, and depending on the type of anchor used, preferably positions the head 70 of the anchor adjacent the rail. In particular, the head 70 of the anchor 12 is preferably looped around the flange on the gage side "GG" of the track 20 at a point on the rail 14 abutting the tie. Again, depending on the type of anchor 12 used, the tail end 74 of the anchor is preferably positioned adjacent to the field side "FD" of the rail 14. However, the tail end 74 of the anchor 12 is typically not positively engaged on the rail by merely positioning it against the rail by the anchor positioning mechanism 52.

Figure 4G:
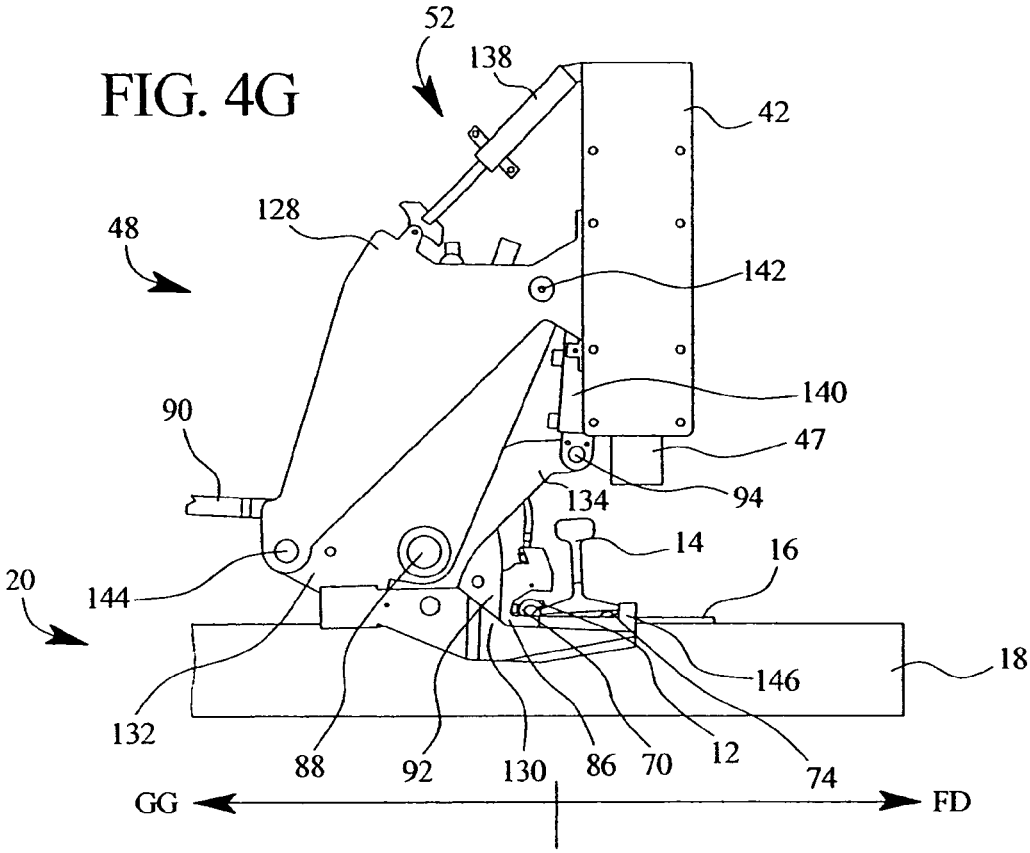
Figure 4H:
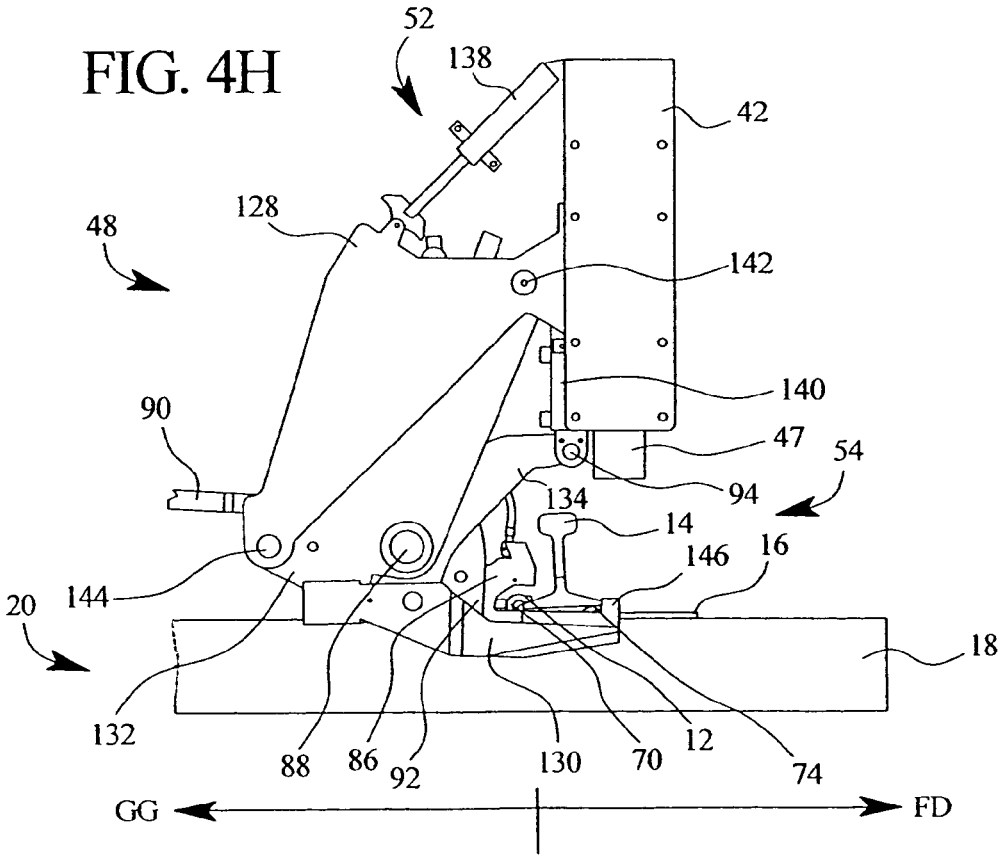

Referring to FIGS. 4G-4H, the rail anchor applicator 10 is provided with the anchor clipping mechanism 54 for clipping both the head 70 and the tail end 74 of the anchor 12 into positive engagement with the rail 14. The anchor clipping mechanism 54 preferably includes the anchor holder 86, the bar clamp arm 130 and a rail stop 146, and all the components and actuators that cause the clipping movement, such as the third actuator 140.

When the anchor holder 86 is pivoted into alignment with the bar clamp arm 130 (FIG. 4C), and the anchor 12 is positioned generally abutting the vertical face of the tie 18 and preferably adjacent the gage side "GG" of the flange during actuation of the anchor positioning mechanism 52 (FIG. 4F), the anchor clipping mechanism 54 is preferably actuated. The anchor clipping mechanism 54 moves generally upward "U", and then generally transversely to the direction of the rail 14, preferably moving the anchor 12 in a generally elliptical path "P" (FIG. 4A) back towards the gage side "GG". Actuation of the third actuator 140 causes the bar clamp arm 130 to move the anchor 12 back toward the gage side "GG" of the rail 14 in the generally elliptical path. The anchor 12 is positively engaged on the rail by "clipping" the head 70 of the anchor with the anchor holder 86 on the gage side "GG", and the tail end 74 of the anchor with the bar clamp arm 130 on the field side "FD". In this configuration, the tail end 74 of the anchor 12 is compressed to clip onto the flange of the rail 14 at the field side "FD" (FIG. 4H).

Figure 5:
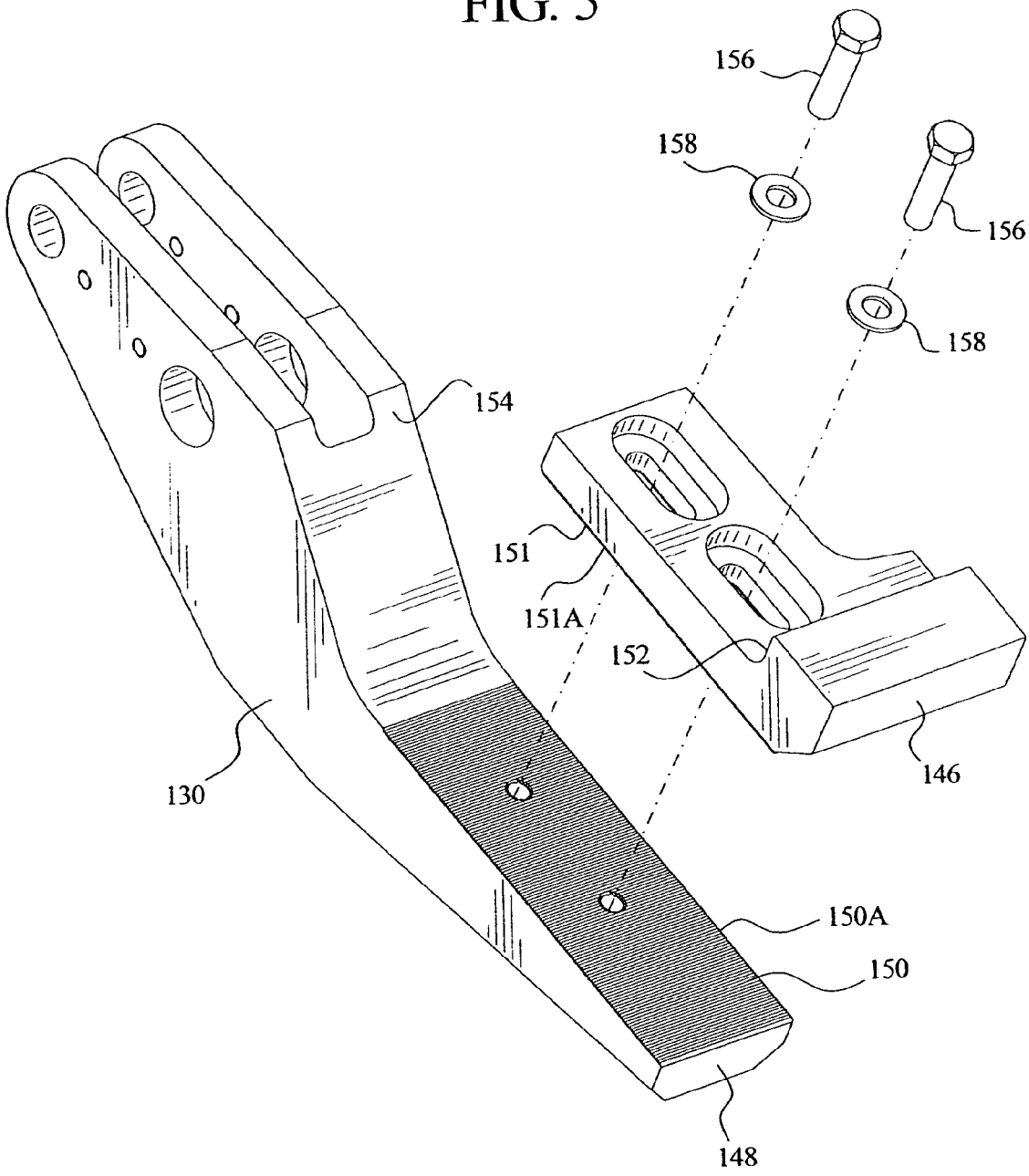
FIG. 5 is an exploded perspective view of a bar clamp arm and a rail stop of the workhead assembly of FIG. 1.

Referring now to FIG. 5, the bar clamp arm 130 is a generally elongate arm having a distal end 148, preferably including an adjustment formation 150. The rail stop 146 is attached to the distal end 148 of the bar clamp arm 130 and preferably has a general "J"-shape with the toe of the "J" generally perpendicular to the bar clamp arm. A clipping surface 152 is preferably generally perpendicular to the bar clamp arm 130 and is configured to impart pressure on and engage the tail end 74 of the anchor 12 against the rail 14. Further, it is preferable that the rail stop 146 be provided with a corresponding adjustment formation 151, configured for selective attachment on the distal end 148 of the bar clamp arm 130 at a preferred location.

The adjustment formation 150 used to adjust the bar clamp arm 130 and the rail stop 146 preferably includes a series of grooves 150A on the bar clamp arm configured to be engaged by the adjustment formation 151 on the rail stop, preferably including a complementary series of grooves 151A. Preferably, a fastener 156 and a washer 158 are used in conjunction with the adjustment formation 150 to position the rail stop 146 onto the distal end 148 of the bar clamp arm 130 to accommodate the variety of anchors 12.

At the beginning of actuation of the anchor clipping mechanism 154, the bar clamp arm 130 and the anchor holder 86 are positioned adjacent to each other such that the open side 101 of the support block 96 abuts the bar clamp arm. In this configuration, a portion of the rail stop 146 is cantilevered over the bar clamp arm 130 and opposes the anchor holder 86. The tail end 74 of the anchor 12 extends from within the seat 98 away from the support block 96 and towards the rail stop 46. In particular, the clipping surface 152 of the rail stop 146 opposes the tail end 74 of the anchor 12.

When actuated, the third actuator 140 extends and rotates with respect to the work frame 42. The third actuator 140 also rotates the minor arm 134 about the major pivot point 94 (FIG. 4F-4H). The pivoting of the minor arm 134, which is attached to the bar clamp arm 130, preferably displaces the bar clamp arm 130 upwards, then transversely back towards the gage side "GG" of the rail 14 in the generally elliptical path "P". The relative motion between the anchor holder 86 and the rail stop 146 clips the anchor 12 onto the rail 14. It is contemplated that one or both of the bar clamp arm/rail stop 130, 146 and the anchor holder 86 moves relative to the other to effect the clipping movement.

The anchor 12 is compressed between components of the clipping mechanism 54, preferably the bar clamp arm/rail stop 130, 146 and the anchor holder 86, which are positioned on both the field side "FD" and the gage side "GG" of the rail. While the pressure may be applied from one component (one of the bar clamp arm/rail stop 130, 146 or the anchor holder) or more components (both the bar clamp arm/rail stop and the anchor holder) depending on which components move toward the rail, the compression occurs transversely across the rail from both the field side and the gage side. The anchor 12 is "sandwiched" between the anchor clipping mechanism components 154, preferably the anchor holder 86 and the rail stop 146, such that the opposing compressive forces are generally transverse to the rail 14 and parallel with the tie 18.

The clipping surface 152 on the rail stop 146 engages the tail 74 of the anchor 12 and "clips" or positively engages the anchor against the bottom flange of the rail 14. While the anchor 12 is being clipped, the anchor is retained in the seat 98 by the clamp 102 in the anchor holder 86, and is confined by the retaining wall 100 on one side, and the rail stop 146 on the other side.

Since anchors 12 have a variety of shapes and sizes, the bar clamp arm 130 and the rail stop 146 can be adjusted with the adjustment formation 150 to accommodate the particular anchor. For example, if the anchor 12 is long and extends a large distance from the anchor holder 86, the rail stop 146 can be fastened to the bar clamp arm 130 so that the distance between a proximal end 154 of the bar clamp arm 130 and the clipping surface 152 is larger. The longer the anchor 12, the more elongated the bar clamp arm 130 and rail stop 146 structure can be adjusted to accommodate the anchor.

Figure 4I:
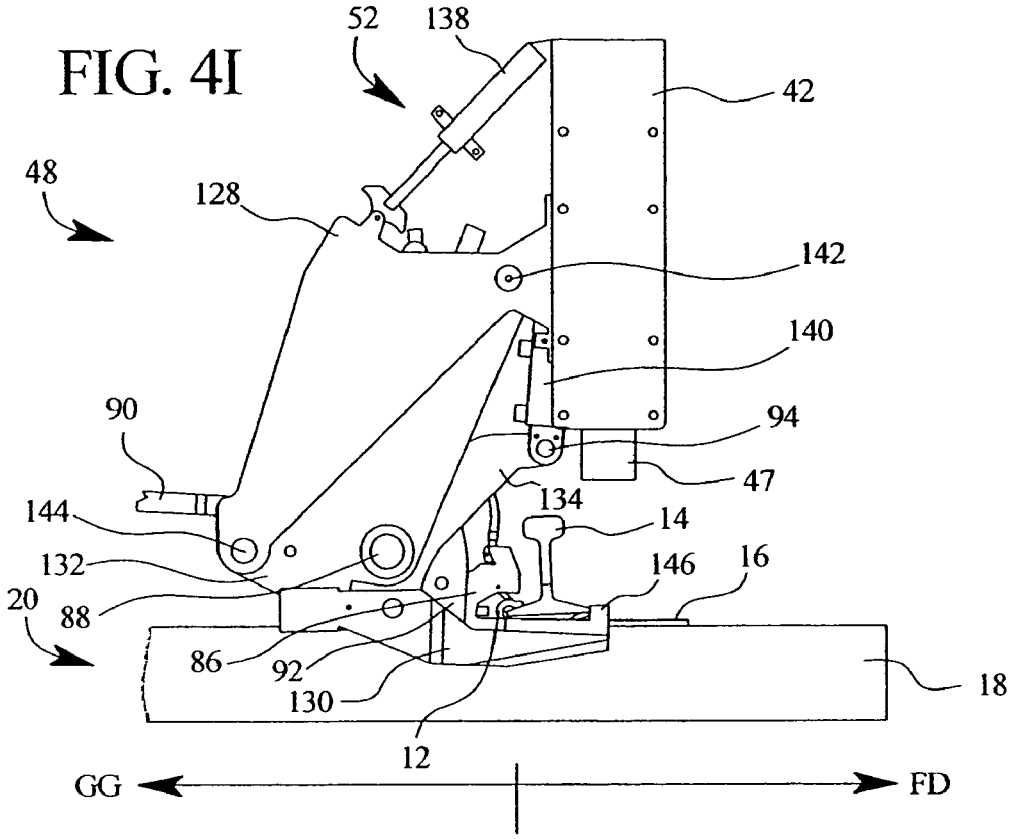
Figure 4J:
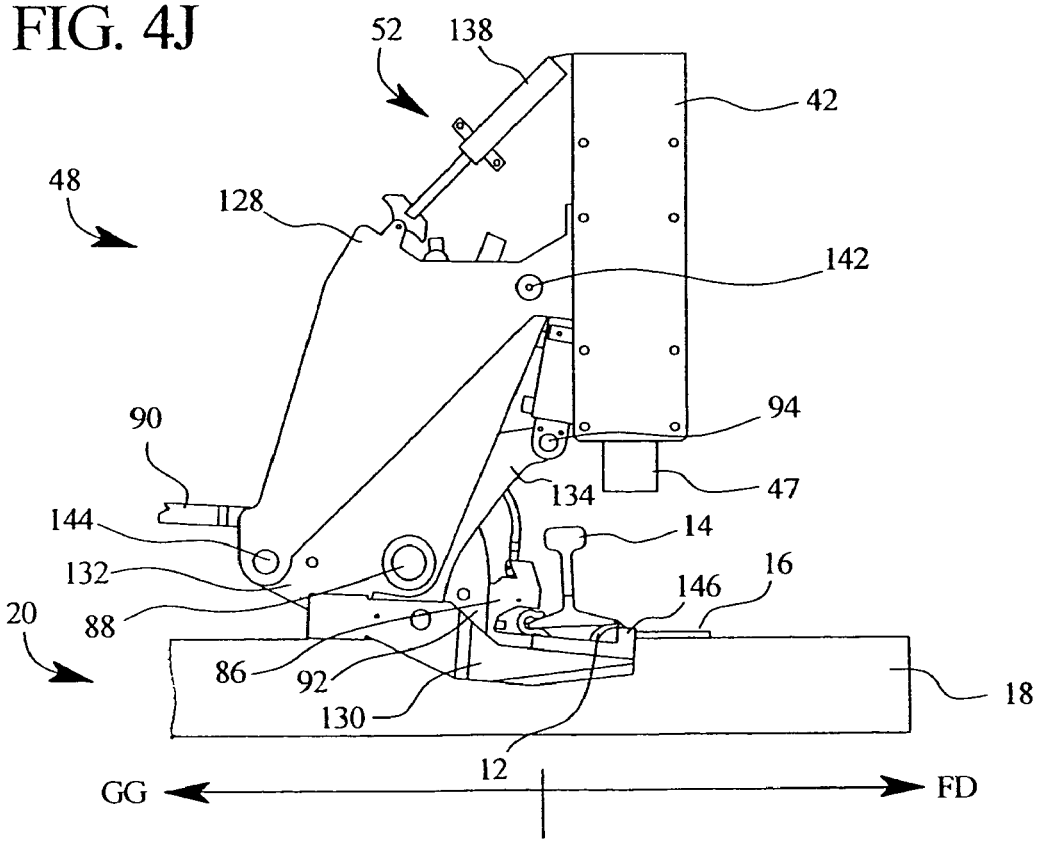
Figure 4K:
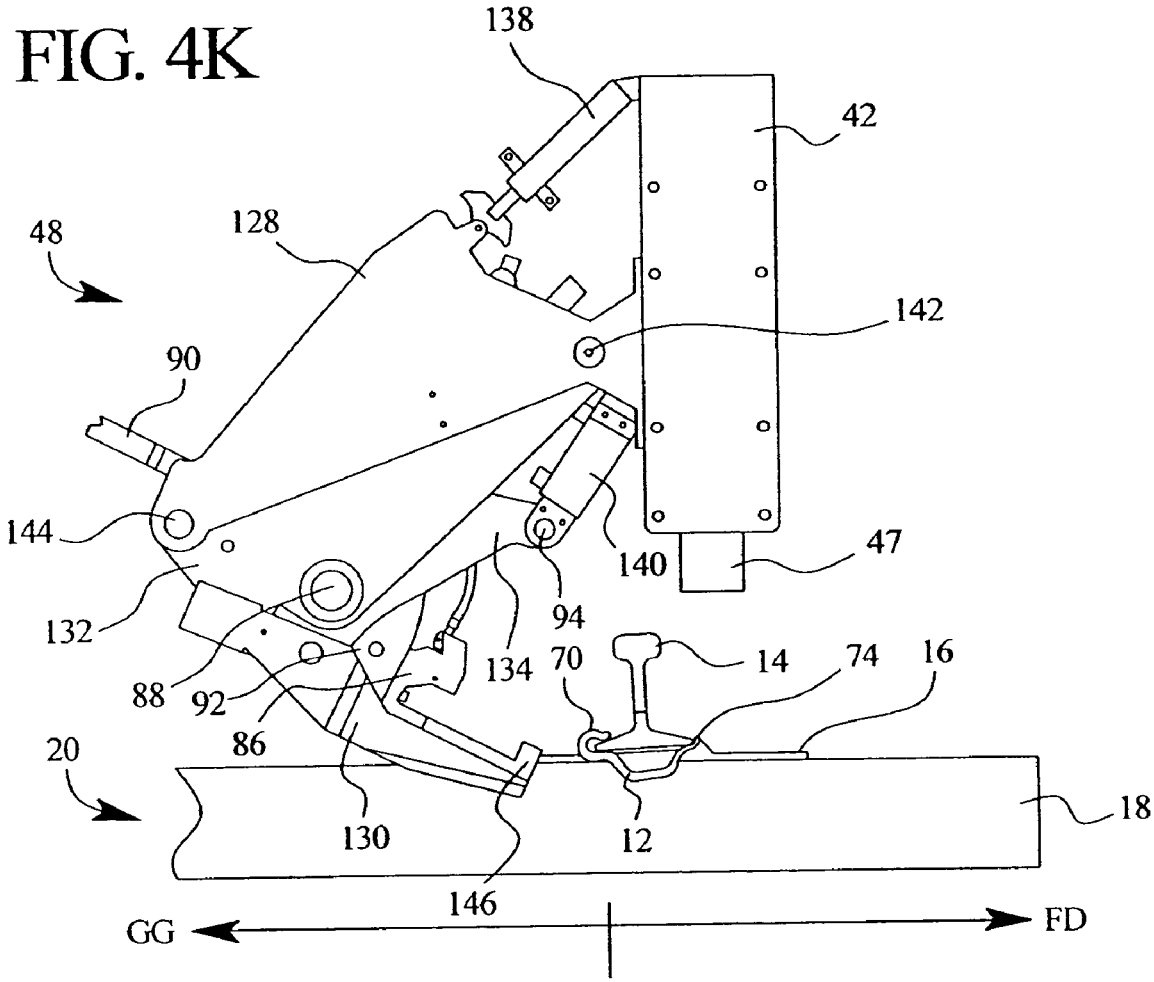

After the anchor 12 has been applied to the rail 14, the clamp 102 on the anchor holder 86 is released, and the mechanical movements of the anchor applicator 10 are preferably reversed to return the anchor applicator to the initial position (FIGS. 4I-4K). Preferably, the workhead assembly 48 is returned to the ready position before the anchor applicator 10 advances down the track 20 to prevent the workhead assembly from colliding with portions of the track or obstructions on the track.

The workhead assembly 48 does not have to be retracted any further than the ready position of FIG. 4A before advancement. That is, the workhead assembly 48 does not have to be taken out of the ready position before traveling to the next location, which saves time in the cycle of the anchor application and in the overall maintenance of the track. Once the vehicle is advanced down the track 20, the workhead assembly 48 is ready to receive another anchor 12 and to cycle through the anchor receiving mechanism 50, the anchor positioning mechanism 52 and the anchor clipping mechanisms 54 to apply another anchor 12.

Referring back to FIG. 3, the operator 30 is preferably seated in the operator's station 28 generally facing towards the workhead assembly 48. It is also contemplated that the operator 30 can be seated to face the direction of travel or both the direction of travel and the workhead assembly 48, or any angle therebetween. In this arrangement, the operator 30 can see down the track 20 to advance the anchor applicator 10 down the track, receive anchors 12 from the bulk loading conveyer 38, feed anchors to the anchor magazine 58, operate the operator input 37, and also monitor the progress of the workhead assembly 48. Further, only one operator 30 is needed for operation of each anchor applicator 10, although it is contemplated that additional operators can be added.

Thus, it will be seen that the present rail anchor applicator 10 provides a relatively reduced application cycle time which is intended to increase operational efficiency of this rail maintenance operation. In addition, the anchor magazine 58 feature has a simple design with a relatively low amount of moving parts. The feature of the plunger 110 in the anchor holder 86 also positively retains the anchor 112 into position against the rail 14 to engage the head 70 onto the flange. Further, the bar clamp arm 130 and the rail stop 146 provide adjustability for different varieties of anchors 12.

Referring back to FIGS. 6-7D, a bottom guide 160 is disposed substantially along the length of the chute 60 along the bottom portion 69. Similar to the top guide 64, the bottom guide 160 is configured to facilitate different sizes and shapes of anchor 12 in the chute 60. Preferably configured to accommodate a FAIR® style anchor (shown in FIG. 7D) in the chute 60, the bottom guide 160 is shown in phantom in FIG. 6. More preferably, when other styles of anchors 12 are used, the bottom guide 160 is preferably removed from the chute 60.

In the preferred embodiment of the bottom guide 160, there are a first and a second elongate portion 162, 164 disposed substantially along the length of the chute 60. The first portion 162 has a front surface 162A that is generally coplanar with a front surface 164A of the second portion 164. A third elongate portion 166 is disposed substantially along the length of the chute 60 between the first and second portions 162, 164, preferably forming a channel. The third portion 166 also has a front surface 166A, the front surface being offset from the first and second front portions 162A, 164A. At least one of the front surfaces 162A, 164A and 166A is configured to slidingly receive the anchor 12 along the length of the chute 60 and to position the anchor into sliding engagement with the top guide 64 of the chute, or alternatively, a top portion 168 of said chute.

The bottom guide 160 is preferably removable and made of an abrasive resistant material, although other materials are contemplated. Alternatively, it is contemplated that the bottom guide 160 may be integral with the tray 66. In the preferred embodiment, the third portion 166 extends at an angle from the first and second portions 162, 164 up along the loading portion 77, and secures the bottom guide 160 onto the loading portion with a hook 170.

While a particular embodiment of the present rail anchor applicator has been described herein, it will be appreciated by those skilled in the art that changes and modifications may be made thereto without departing from the invention in its broader aspects and as set forth in the following claims.

The invention claimed is:

1. A magazine suitable for use with a rail anchor applicator, said anchor applicator having an anchor receiving mechanism for receiving at least one anchor having a head, a tail, a length dimension longer than a width and a depth dimension, comprising:

a generally U-shaped chute structure having a length from a top end to a bottom end, said chute structure having an interior depth defined between two legs of the U-shaped chute structure, and said chute structure having an interior width defined between a top guide and a bottom portion of said chute structure, said chute structure constructed and dimensioned for storing a plurality of anchors in a slidable, sequential, non-nested arrangement in one of a head-to-tail and tail-to-head orientation and for delivering the anchors to the anchor receiving mechanism in said orientation;

wherein said top guide is configured to engage the anchor, and said top guide is configured to locate both the head and the tail of the anchor into engagement with said bottom portion; and wherein when the anchors are stored in said chute structure, the length dimension of the anchor is generally parallel to said length of said chute structure.

2. The anchor magazine of claim 1 further comprising a laterally flared loading portion in communication with said chute configured to sequentially receive the anchors over an expanded width relative to said width of said chute and to deliver the anchors down said chute.

3. The anchor magazine of claim 1 further comprising at least one escapement pin disposed at a delivery end of said chute and configured to selectively permit the exit of the anchor from said delivery end.

4. The anchor magazine of claim 1, wherein said chute is pivotable about a pivot point on the anchor applicator for displacing the chute relative to the anchor receiving mechanism.

5. The anchor magazine of claim 1, wherein said chute extends generally from an operator's work area on the anchor applicator generally to the anchor receiving mechanism.

6. A funnel-like loading portion associated with an anchor applicator magazine for receiving and orienting an anchor prior to delivery to the anchor applicator magazine, comprising:

a first end having an expanded width;

a second end opposite said first end having a decreased width;

at least one taper portion disposed between said first end and said second end and having a tapering width between said expanded width and said decreased width, said taper portion is sized and arranged to receive the anchor generally at said first end and to position the anchor at said second end to be located generally in the plane of a chute of the anchor applicator magazine; and a bottom portion disposed adjacent said taper portion and sized and arranged to place the anchor in one of a head-to-tail and tail-to-head orientation at said second end;

wherein said second end is one of integral with and disposed adjacent to said chute for depositing anchors into said chute.

7. The loading portion of claim 6 wherein said expanded width is approximately three times said decreased width.

8. The loading portion of claim 6 wherein said first and second ends define generally rectangular orifices.

9. A top guide for an anchor applicator magazine, comprising:

first and second elongate members disposed substantially along the length of a chute of the magazine, said first member having a front surface that is generally coplanar with a front surface of said second member;

a third elongate member disposed substantially along the length of said chute, said third member disposed between said first and second members and having a front surface offset from said front surfaces of said first and second members;

wherein at least one of said front surfaces is configured to slidingly receive an anchor along the length of said chute and to position said anchor into sliding engagement with a wall of said chute opposite said elongate members;

wherein said first, second and third members are displaceable in the direction generally transverse to the length of the chute to decrease the inside surface area of the chute uniformly along the length of the chute where said first, second and third members are disposed.

10. The top guide of claim 9 wherein said first, second and third members are one of integral and attached to each other.

11. An anchor magazine for storing anchors, comprising:

a chute having a length from a top end to a bottom end; and a loading portion one of integral with and disposed adjacent to said top end of said chute for depositing anchors into said chute, said loading portion comprising:

a first end having an expanded width;

a second end opposite said first end having a decreased width;

at least one taper portion disposed between said first end and said second end and having a tapering width between said expanded width and said decreased width, said taper portion is sized and arranged to receive the anchor generally at said first end and to position the anchor at said second end to be located generally in the plane of a chute of the anchor applicator magazine; and a bottom portion disposed adjacent said taper portion and sized and arranged to place the anchor in one of a head-to-tail and tail-to-head orientation at said second end.

12. An anchor magazine for storing anchors having a length dimension larger than a width and a depth dimension, comprising:

a chute having a length and constructed and having a width dimensioned for storing anchors in a non-nested and one of a head-to-tail and tail-to-head orientation, and for sequentially, slidably delivering said anchors from a first end of said chute to a second end of said chute; and a top guide disposed within said chute, said top guide comprising:

first and second elongate members disposed substantially along the length of said chute of the magazine, said first member having a front surface that is generally coplanar with a front surface of said second member;

a third elongate member disposed substantially along the length of said chute, said third member disposed between said first and second members and having a front surface offset from said front surfaces of said first and second members;

wherein at least one of said front surfaces is configured to slidingly receive an anchor along the length of said chute and to position said anchor into sliding engagement with a wall of said chute opposite said elongate members;

wherein said first, second and third members are displaceable in the direction generally transverse to the length of the chute to decrease the inside surface area of the chute uniformly along the length of the chute where said first, second and third members are disposed.

* * * * *